US006172694B1

(12) United States Patent
Droege et al.

(10) Patent No.: US 6,172,694 B1
(45) **Date of Patent: *Jan. 9, 2001**

(54) CHECK VALVE FOR INK JET PRINTING

(75) Inventors: Curtis R. Droege, St. Clair County, IL (US); Donald E. Sherman, St. Louis County, MO (US); Kevin W. Kuester, St. Clair County, IL (US)

(73) Assignee: Marconi Data Systems Inc., Wood Dale, IL (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/799,271

(22) Filed: Feb. 13, 1997

(51) Int. Cl.[7] ..... B41J 2/175
(52) U.S. Cl. ..... 347/85
(58) Field of Search ..... 347/6, 7, 85, 86; 137/454.2; 417/536, 393

(56) References Cited

U.S. PATENT DOCUMENTS

| | | | | |
|---|---|---|---|---|
| 4,305,701 | | 12/1981 | Geil | 417/307 |
| 4,364,059 | | 12/1982 | Nagayama | 347/89 |
| 4,403,229 | | 9/1983 | Barteck | 347/89 |
| 4,432,005 | | 2/1984 | Duffield et al. | 347/86 |
| 4,460,904 | | 7/1984 | Oszczakiewicz et al. | 347/89 |
| 4,514,742 | * | 4/1985 | Suga et al. | 347/85 |
| 4,827,280 | * | 5/1989 | Stamer et al. | 347/6 |
| 5,154,761 | | 10/1992 | Cooke et al. | 106/22 |
| 5,160,535 | | 11/1992 | Cooke et al. | 106/19 R |
| 5,364,244 | * | 11/1994 | Taylor-McCune et al. | 417/536 |
| 5,369,429 | | 11/1994 | Erickson | 347/7 |
| 5,404,158 | | 4/1995 | Carlotta et al. | 347/32 |
| 5,446,486 | | 8/1995 | Reis | 347/85 |
| 5,596,354 | | 1/1997 | Murphy | 347/30 |

OTHER PUBLICATIONS

IBM Bulletin, Jun. 1973 J.W. Haskell.
Marsh Company—Ink Jet Systems Product Guide—9 page bound brochure.

* cited by examiner

*Primary Examiner*—N. Le
*Assistant Examiner*—Anh T. N. Vo
(74) *Attorney, Agent, or Firm*—Polster, Lieder, Woodruff & Lucchesi

(57) ABSTRACT

This invention relates to a check valve (19) for use in an ink supply line (13) of an ink jet printing system (1) between an ink reservoir (11) and an inkjet printhead (3) so as to prevent de-priming of the printhead upon the latter being subjected to impact loads or the like. Specifically, the improvement of this invention comprises a one-piece check valve (37) of an elastomeric material having a flapper valve (43) movable between a closed position in which the flapper valve blocks the backflow of ink and an open position in which ink is free to flow past the check valve member to the printhead. The flapper valve (43) is defined by a slot (49) separating the flapper valve from the outer margin (41) of the check valve (37) and the flapper valve is integrally joined to the outer margin by a hinge portion (45) so as to enable movement of the flapper valve between its open and closed positions.

6 Claims, 4 Drawing Sheets

CHECK VALVE FOR INK JET PRINTING

BACKGROUND OF THE INVENTION

This invention relates to ink jet printing, and, more specifically, to ink jet printing systems used to imprint packages or cartons with various indicia as the packages are conveyed past an ink jet printhead at a printing station positioned along a conveyor path. Such inkjet printing systems are oftentimes used to imprint shipping information, bar codes, lot numbers and other production or shipping information on overcartons or secondary packaging in a production packaging line or the like. The printhead of such inkjet printing systems is typically supplied with ink from an ink supply remote from the printhead by means of appropriate ink tubes or lines.

Because the printheads are located in close proximity to the cartons (or other objects to be imprinted) as they are conveyed past the printhead if a carton is not properly positioned on the conveyor line, the carton may come into contact with the printhead as the carton is conveyed therepast. In some applications, the cartons are conveyed past the printhead with considerable speed (up to 150 feet/minute or more) and the cartons are heavy. Upon the printhead being hit by one of these heavy cartons being conveyed at such speeds, a considerable impact or shock load is imparted to the printhead. It is known that such impact loads can cause the printhead to de-prime.

It is believed that upon the above-described shock load being imparted to the printhead, a back pressure or shock wave is generated within the ink supply line which travels at extremely high speed through the ink supply line toward the ink reservoir. This shock wave can so reduce the pressure within the ink supply line as to de-prime the printhead. More specifically, and especially with capillary ink feed systems, it is believed that the shock wave may generate back pressures in the ink supply system sufficient to break the meniscus of the ink in the ink orifices of the printhead thus de-priming the printhead. Such de-priming of the printhead is a serious problem.

In the event the printhead de-primes, the printhead will not print until it again is primed with ink. If cartons conveyed past the printhead in a production packaging line are not imprinted, the cartons must be removed from the production line and must either be manually marked or, after the printhead is re-primed, must be positioned on the conveyor line so as to be again conveyed past the printhead for being properly imprinted by the printhead. This, of course, can cause major problems on a production line using such ink jet printing systems.

In addition, it is a time consuming process to re-prime a printhead during which time the packaging line on which the printing system is installed must be shut down. Of course, it is highly undesirable and costly to shut down a production packaging line. In addition, with certain ink jet printing systems, special inks are required to prime the printheads. These special priming inks are expensive and are time consuming to use.

It has long been a goal for such ink jet print systems, and particularly for capillary ink feed systems, to lessen the tendency of the printhead to de-prime. One way of reducing the tendency of the printhead to de-prime has been to incorporate a check valve in the ink supply line between the ink reservoir and the printhead. Upon a back pressure or shock wave being generated in the printhead and traveling back through the ink supply line, and upon this back pressure or shock wave encountering the check valve, the check valve will close thus preventing the shock wave from traveling to the ink supply. However, it has been found that the incorporation of prior art check valves (as hereinafter described in detail), in the ink supply circuit has not abated the tendency of the printhead to de-prime. It is believed that movement of the check valve member from its open to its closed position can sometimes generate a region of low pressure within the ink supply system which can cause a pressure differential of sufficient magnitude to result in de-priming of the printhead.

Still further, the incorporation of a check valve in the ink supply system has other draw backs. First, if the check valve is normally closed, upon initiating flow of ink to the printhead (which is usually in pulses rather than in a steady state flow), the normally closed check valve will require a higher pressure to initially open the check valve (referred to as a cracking pressure). Further, such check valves are susceptible to contamination from particles in the ink such that an accumulation of such contamination particles may adversely affect the operation of such check valve. Still further, the incorporation of such a check valve in the ink supply lines causes a flow restriction that may adversely affect the flow of ink to the printhead and may increase the response time of the ink supply system to the printhead.

As noted, prior art printheads have used check valves in the past. As shown in FIG. 10 of the drawings, a first embodiment of such a prior art check valve is shown which has been used with a capillary ink supply system for an ink jet printhead. This prior art check valve, as indicated in its entirety at 101, has a valve body 103 having an inlet 105 and an outlet 107 with a check valve chamber 109 therewithin. A check valve member, as indicted at 111, is provided in chamber 109 which is movable from a closed position in which the downstream face of the check valve member is in sealing engagement with the downstream face of the chamber 109 surrounding inlet 105 so as to block the backflow of ink from chamber 109 into inlet 105. Upon the check valve member 111 being subjected to normal flow via the inlet 105 from the ink supply to the printhead, the flow will cause the check valve member 111 to shift from its above-described closed position to an open position within chamber 109 in which ink may flow around the periphery of the check valve member 111 and to be discharged from the outlet 107 for flowing to the printhead. In such prior art check valves, the check valve member 111 was typically made of a flexible, resilient elastomer, such as a suitable silicone rubber material or the like, and the check valve member has a diameter somewhat less than the inner diameter of chamber 109 such that the check valve member is free to move within the chamber between its open and its closed positions. As shown, with the check valve member 111 in its open position, the ink is free to enter the chamber 109 on the downstream face of check valve member 111 and to flow around the periphery of the check valve member and to flow to outlet 107.

It will be appreciated that the average flow rate of ink through the above-noted check valves to the printhead is very low (e.g., about 0.5 ml./min.). Moreover, the size of such check valves is small. For example, the diameter of the check valve member 111, as shown in FIG. 8 may only be about 0.110 inches. Referring again to the check valve shown in FIG. 7, upon a shock wave (back pressure pulse) traveling from the printhead to the check valve, the shock wave will travel through the outlet 107 and will enter chamber 109. There, the back pressure or shock wave will act against the entire upstream face of valve member 111 thus causing the member to move axially within chamber 109 to its closed position. However, upon the valve member moving within the chamber from its open to its closed position, the volume of the chamber on the upstream side of the valve member expands greatly and thus generates a low pressure void within the valve chamber. This in turn lowers the pressure within the ink supply line upstream from the check valve and within the printhead. This low pressure may be sufficient to overcome the meniscus force of the ink within the ink orifices of the printhead and thus may result in de-priming of one or more orifices of the printhead. Thus, even with the presence of such check valve in the ink supply system, the check valve did not eliminate the de-priming problem and may even be a cause of printhead de-priming.

In an effort to overcome the shortfalls of the check valve shown in FIG. 10, a second embodiment of a prior art check valve, as shown in FIG. 11, has been used with such ink jet printing systems in an effort to further minimize the tendency of the printhead to de-prime upon the printhead being struck by a carton, as above-described. In this other embodiment of a prior art check valve, the check valve, as indicated in its entirety at 201, has a valve body 203 having an ink inlet 205 and an ink outlet 207 with a check valve chamber 209 therebetween. Similar to valve 101 heretofore described, check valve 201 has an elastomeric check valve member 211 disposed in chamber 209 for blocking back flow from the chamber to inlet 205 when the check valve member 211 is in its closed position. In addition, a part spherical or a conical support 213 is provided at the downstream side of the chamber and the support has an apex 215. Support 213 is of open construction so that ink may flow through the support to the outlet 207. Check valve member 211 is disposed between the downstream face of chamber 209 and support 213 such that the center of the downstream face of the check valve member is engageable by apex 215 of support 213. Check valve member 211 is normally of a flat, planar shape. However, upon installation of check valve member 211 in chamber 209, the check valve member is deformed into a convex configuration, as shown in FIG. 11, in which the outer margins of the downstream face of the check valve member are in sealing contact with the downstream end of chamber 209 so as to block the flow of ink from inlet 205 to outlet 207. Upon a slight pressure differential within chamber 209 so as to cause ink to flow from inlet 205 to outlet 207, the apex 215 is engaged by the check valve member and the outer margins of the check valve member are caused to flex inwardly away from the sides of chamber 209 and the upstream face of the check valve member moves clear of the inlet face of the chamber thereby to enable ink to flow to outlet 207.

Upon a shock wave being generated in the printhead (in the manner above described), the shock wave will enter chamber 209 via outlet 207 and will act against the concave upstream face of valve member 211 facing conical support 213. This causes the valve member to shift toward its closed position and the outer edges of the check valve member move outwardly so as to sealingly engage the walls of chamber 209 and to check the backflow of the ink.

It will be appreciated that the check valves of FIGS. 10 and 11 are not drawn to the same scale. Specifically, check valve 201 shown in FIG. 11 has a considerably larger cross section than check valve 101 shown in FIG. 10. For example, the diameter of check valve member 211 is about three (3) times the diameter of check valve member 111. As a result of this larger size, the check valve member also allows a low pressure zone to be formed within chamber 209 which can result in de-priming of the printhead. Further, check valve 201 is also susceptible to contamination particles interfering with operation of the check valve, and valve 201 still requires a cracking pressure to initiate ink flow.

There has been a long-standing need for a check valve for use in an ink jet ink supply system, which more effectively prevents de-priming of the printhead, which requires less cracking pressure, which is less susceptible to ink contamination particles interfering with operation of the check valve, and which has a faster response time than prior check valves.

BRIEF SUMMARY OF THE INVENTION

Among the several objects and features of the instant invention may be noted the provision of a check valve which may be readily incorporated within the ink supply system of a capillary ink supply for an ink jet printing system between the ink supply reservoir and the ink jet printhead which reliably prevents de-priming of the printhead upon the printhead being subjected to an impact or shock load, such as upon the printhead being hit by a package conveyed therepast.

The provision of such a check valve which has a minimum cracking pressure and which has a minimum response time such that the check valve has little or no adverse affect on the normal operation of the ink supply system.

The provision of such a check valve which is not adversely sensitive to deposits of contamination particles which may accumulate within the check valve over an extended period of service.

The provision of such a check valve which is of simple and low construction, and which is reliable in operation.

Other objects and features of this invention will be in part apparent and in part pointed out hereinafter.

This invention is a check valve for use in an ink supply line of an ink jet printing system between an ink reservoir and a inkjet printhead so as to prevent de-priming of the printhead upon the latter being subject to impact loads or the like. The check valve has a body having an inlet adapted to be connected to and ink reservoir, an outlet adapted to be connected to the printhead, a chamber within the housing between the inlet and the outlet, and a check valve member within the chamber movable between a closed position in which ink back flow from the chamber into the inlet is prevented and an open position in which ink from the inlet may flow to the outlet and thence to the printhead. Specifically, the check valve member is an elastomeric member having a flapper valve portion movable between a closed position in which the flapper valve blocks the backflow of ink from the chamber into the inlet and an open position in which ink is free to flow past the check valve member from the inlet to the outlet. The flapper valve portion is defined by a curved slot separating the flapper valve from the outer margin of the check valve member. The flapper valve is integrally joined to the outer margin by a hinge portion so as to enable movement of the flapper valve relative to the outer margin of the check valve member between its open and closed positions.

BRIEF DESCRIPTION OF THE SEVERAL VIEWS OF THE DRAWINGS

FIG. 2 is an exploded perspective view of the print engine of the printhead having multiple ink jet orifices therein and illustrating a check valve of the present invention installed in the ink supply line proximate the print engine for preventing de-priming of the orifices upon the printhead being subjected to an impact load or the like;

Corresponding reference characters indicate corresponding parts throughout the several views of the drawings.

DETAILED DESCRIPTION OF THE INVENTION

Figure 1:
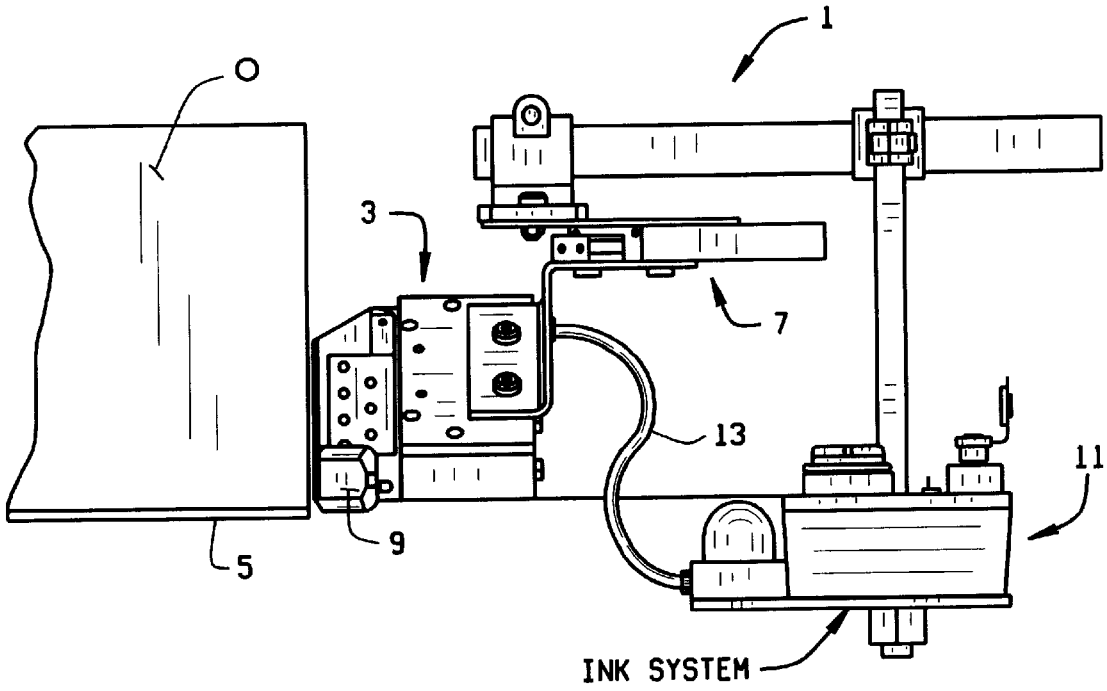
FIG. 1 is an elevational view of an inkjet printhead positioned proximate a conveyor along which objects (cartons) to be printed by the printhead are conveyed past the printhead with the printhead being supplied ink from an ink reservoir via an ink supply line.

Referring now to the drawings, and more specifically to FIG. 1, an inkjet printing station, as generally indicated at 1, is shown in which an inkjet printhead 3 is positioned proximate a conveyor line 5 which conveys objects O (cartons) past printhead 3 so that the printhead may inkjet print indicia on the objects as the objects are conveyed past the printhead. The objects O to be imprinted are cartons and the cartons are conveyed in the direction "out of the paper", as shown in FIG. 1. It will be noted that the printing face of the printhead is in close proximity to the face of the carton to be imprinted. As described in the co-assigned U.S. patent application Ser. No. 08/728,744 filed Oct. 11, 1996, the printhead may be mounted on a resilient mount 7 so as to allow the printhead to be engaged by a carton conveyed along the path of the conveyor. The printhead has spring guides 9 which are engaged by the carton such that the printhead is moved from an inward initial position to a printing position with the printing face of the printhead being resiliently held in a desired printing position with respect to the surface of the carton to be printed. However, because the cartons may vary in size and because the cartons may be mis-positioned on the conveyor, in some instances the cartons contact the printhead at such speed and with such force that the printhead is subjected to high impact loads which may de-prime the printhead, as described in the Background of this Invention. Print station 1 further comprises an ink supply or reservoir, as indicated at 11, and ink is supplied to printhead 3 from the ink supply by means of an ink supply line 13.

Figure 2:
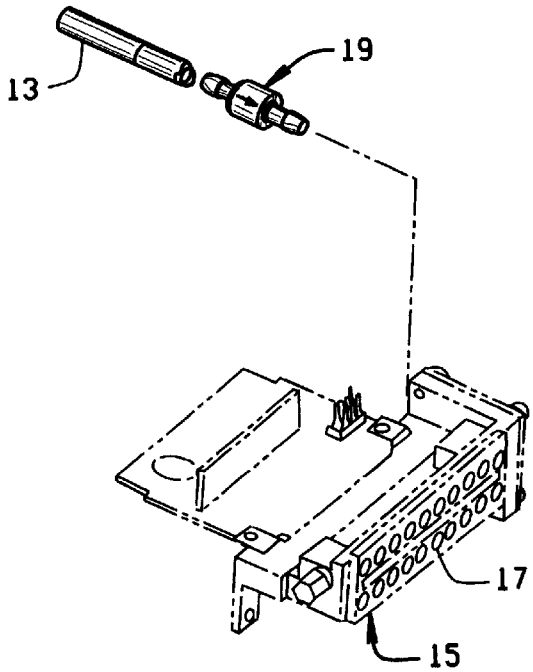

Referring now to FIG. 2, the print engine, as indicated at 15, of printhead 3 is shown to have a plurality of ink jet printing orifices 17 for emitting ink jet droplets in a controlled fashion for imprinting indicia on cartons O in the conventional manner. Ink supply line 13 has a check valve of the present invention as indicated generally at 19, installed therein adjacent print engine 15 for preventing the back flow of ink to the reservoir which may cause de-priming of the orifices 17 of the print engine upon the printhead being subjected to impact loads as upon being struck by a carton or the like conveyed past the printhead. Preferably, check valve 19 is housed within printhead 3.

The print engine herein shown uses a so-called capillary ink supply system, but it will be understood that other types of print engines are also subject to de-priming and the check valve 19 of the present invention (as will be hereinafter described) may be used with such other ink jet printing systems to prevent de-priming.

Figure 3:
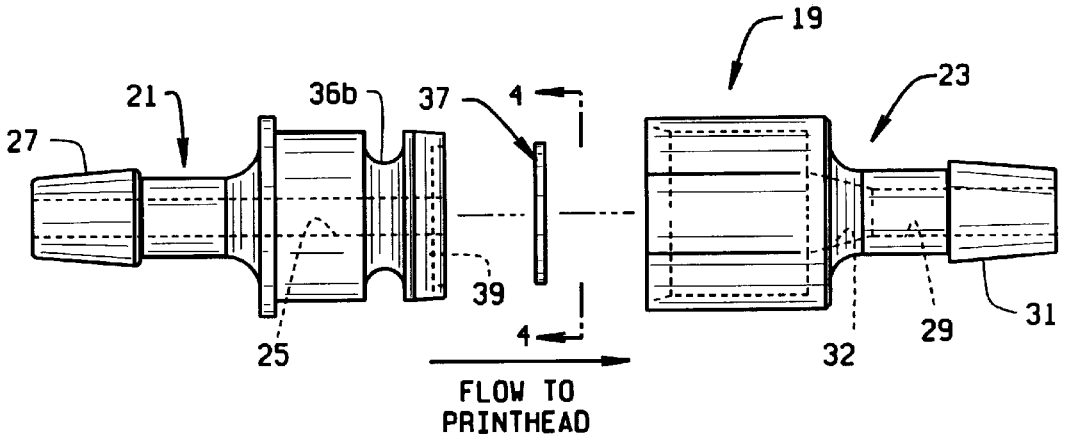
FIG. 3 is an enlarged side elevational exploded view of the check valve of the present invention illustrating an inlet fitting, and outlet fitting, and a check valve member interposed therebetween.
Figure 4:
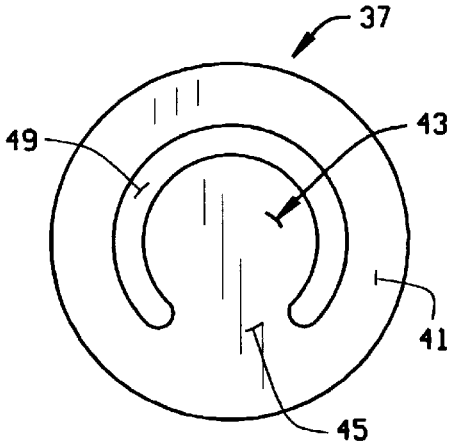
FIG. 4 is a view taken along line 4—4 of FIG. 3 illustrating a flapper-type check valve member of the present invention.

Referring now to FIG. 3, check valve 19 of the present invention is shown to comprise an inlet fitting 21 and an outlet fitting 23. These fittings are preferably molded of a suitable synthetic resin material, such as Delrin or Acetron GP. Inlet fitting 21 has an inlet bore 25 and a nipple end 27 which is adapted to be sealably inserted into ink supply line 13 so that ink from ink reservoir 11 may flow to printhead 3. Likewise, outlet fitting has an outlet bore 29 and a similar nipple end 31 so that the outlet fitting may be operably connected to print engine 15 so as to supply ink to the various ink jet orifices 17. It will be appreciated that the inlet and outlet bores 25 and 29, respectively, are of relatively small diameter (e.g., 0.081 inches). It will be appreciated that outlet bore 29 may have an inwardly converging upstream end, as indicated at 32, for receiving ink from the inlet fitting.

Figure 5:
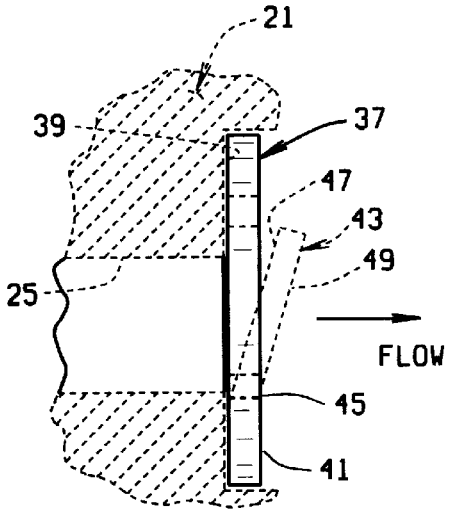
FIG. 5 is a side elevational view of the check valve member shown in FIG. 4 with the flapper valve (as shown in solid lines) in its closed position in which the upstream face of the flapper valve is in sealing engagement with the structure (shown in phantom) of the fitting housing forming the inlet bore of the check valve thereby to prevent back flow of ink from the printhead to the ink supply and an open position (as shown in dotted lines) in which the flapper valve is hingedly moved away from the fitting structure thus allowing ink to flow from the inlet bore to the printhead.
Figure 6:
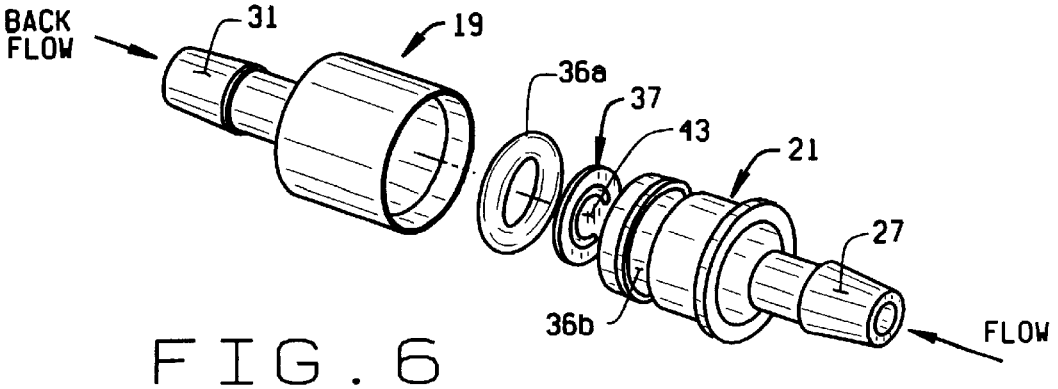
FIG. 6 is an exploded perspective view of the check valve of the present invention.
Figure 7:
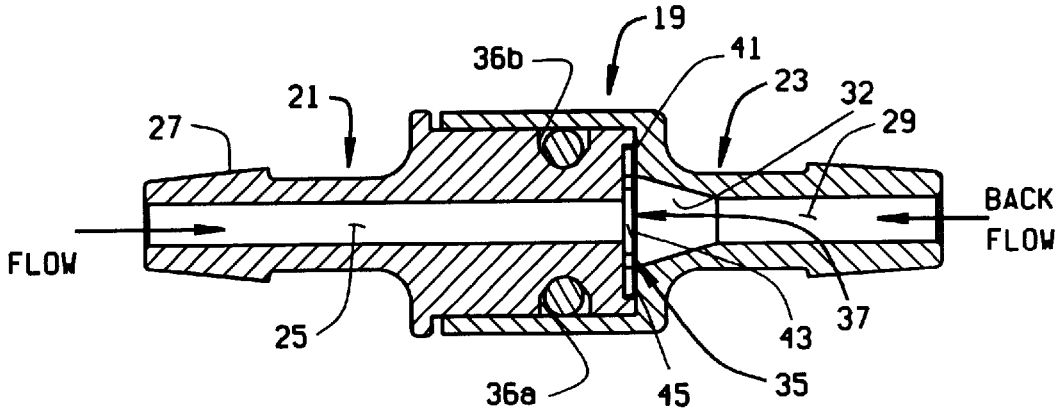
FIG. 7 is a longitudinal cross sectional view of the check valve of the present invention.

As shown in FIG. 6, with the inlet and outlet fittings 21 and 23 assembled, a check valve body, as indicated in the entirety at 33, is formed with the latter having a check valve chamber 35 therewithin. Inlet fitting 21 is sealed relative to check valve fitting 23 when assembled by means of an O-ring 36*a* received in an O-ring groove 36*b* formed in inlet fitting 23. Within check valve chamber 35, a check valve member 37 is sealingly secured relative to the check valve body. As shown in FIGS. 3 and 5, inlet fitting 21 has a recess 39 (also referred to as the upstream end face of check valve chamber 35, namely the end face of the chamber toward the ink supply) formed therein which receives check valve member 37. Check valve member 37 is preferably a one piece elastomeric member having an outer marginal portion 41 and an inner tongue or flapper valve portion 43 integral with the outer marginal portion and attached thereto by a hinge portion 45 for permitting angular hinged movement of the flapper valve portion 43 relative to the outer marginal portion 41 between a closed position (as shown in solid lines in FIG. 5) in which the upstream face 47 of the flapper valve in is sealing engagement with the inlet fitting so as to block the flow of ink from inlet bore 25 into check valve chamber 35 and an open position (as shown in dotted lines in FIG. 5) in which the upstream face 47 of flapper valve portion 43 is spaced from the inlet fitting proximate the outlet of bore 25 so as to enable the flow of ink from the inlet bore into the check valve chamber. As shown in FIG. 6, upon flapper valve portion moving to it open position, the flapper valve will be at least in part received in the conical converging section 32 of outlet bore 29 of the outlet fitting.

It will be appreciated that flapper valve 43 is formed integrally with outer portion 41 via hinge portion 45 and that the flapper valve is separated from the outer portion by a slot 49. Preferably, slot 49 is of a generally U-shaped configuration such that the flapper valve is also of U-shaped configuration. However, within the broader scope of this invention, the flapper valve may be of shapes other than a U-shaped configuration. For example, flapper value may be rectangular or even of triangular shape. Hinge portion 45 is located at the open end of the U-shaped slot 49. Further, slot 49 is preferably of sufficient width such that the outer edges of flapper valve portion 43 are clear of (do not touch) the inner edges of outer portion 41. With a slot of such width, the operation of the check valve has been found to be less susceptible to dirt or other particles in the ink and thus the check valve of the present invention reliably operates even under conditions of high particle contamination. Since flapper valve portion 43 is formed (cut) from a generally flat (planar) blank of elastomeric sheet material, it will be appreciated that the flapper valve as a memory such that the flapper valve is resiliently biased to return to its flat planar (closed) position upon removal of an opening force (e.g. the flow of ink to the printhead).

As noted, the check valve 19 of the present invention is of relatively small size. For example, the assembled check valve is only about 1.2 inches in length and has an outside diameter of about 0.375 inches. The diameter of check valve member 37 is about 0.25 inches and the part circular shaped flapper valve portion 43 has a diameter of about 0.12 inches. The thickness of the check valve member 37 is about 0.024–0.025 inches. Preferably, slot 49 is about 0.02 inches in width. As noted, check valve member is preferably of a suitable elastomer material, such as silicone rubber, ASTM 9668, without fabric reinforcement. The silicone elastomer may preferably, but not necessarily, have a durometer rating of about 50±5 on the Shore A scale.

In operation, with the check valve 19 of the present invention installed in the ink supply line 13 between in reservoir 11 and print engine 15, flapper valve 43 is in its normally closed to its open position (as shown in dotted lines in FIG. 5). Upon ink being drawn to printhead orifices 17, as by capillary action or the like, the flow of ink from ink supply 11 to printhead 3 is indicated. Because of the resilient construction of check valve member 37, and particularly because of the low stiffness of hinge 45, flapper valve requires very little force to move it from its closed to its open position. As noted above, this force required to open the check valve is sometimes referred to as the "cracking force" for the check valve. With the very low flowrates of ink drawn from the ink supply to the printhead and under the very low pressure differentials generated by the capillary flow of ink, flapper valve 43 is readily opened with very low cracking force and with very little resistance to the flow of the ink. Flapper valve 43 will remain open so long as ink continues to flow to the printhead in the normal manner, even at the above-noted low flow rates which may, for example, range from to slightly more than 0 to about 4 ml./min. It will be further appreciated that if the flow to the printhead is in pulses rather than a steady state flow, the flapper valve of the check valve of the present invention will not unduly impede or restrict such flow of ink to the printhead.

In the event the printhead 3 is subjected to an impact or shock load, as, for example, may be caused by the printhead being struck by a carton O being conveyed along conveyor 5, such impact or shock force may form a back pressure or shock wave in the ink within the orifices 17 and within the ink supply line proximate the printhead. This back pressure or shock wave will be transmitted at relatively high speed through the ink supply line 13 back toward ink supply 11. As noted, check valve 19 of the present invention, is installed in ink supply line 13 (preferably relative near printhead 3) so as to prevent the transmission of this back pressure or shock wave from de-priming orifices 17 of ink which will, in turn, prevent printhead from printing.

With flapper valve 43 in its open position (as shown in dotted lines in FIG. 5), upon the back pressure or shock wave traveling through ink supply line 13 from the printhead to the check valve, upon the back pressure or shock wave entering check valve chamber 35, this back pressure will act against the side of the flapper valve member 43 facing the printhead (referred to as the downstream face of the flapper valve), and this back pressure or shock wave will exert a force on the flapper valve that results in the near instant closing of the flapper valve against face 39 of the check valve chamber thus blocking the back flow of ink from the printhead into inlet 25. In this manner, the generation of a negative pressure in the ink supply line between the printhead and the check valve sufficient to result in the de-priming of the inkjet printing orifices 17 of the printhead, even when the printhead is subjected to very high shock or impact loads, is effectively presented.

Figure 8:
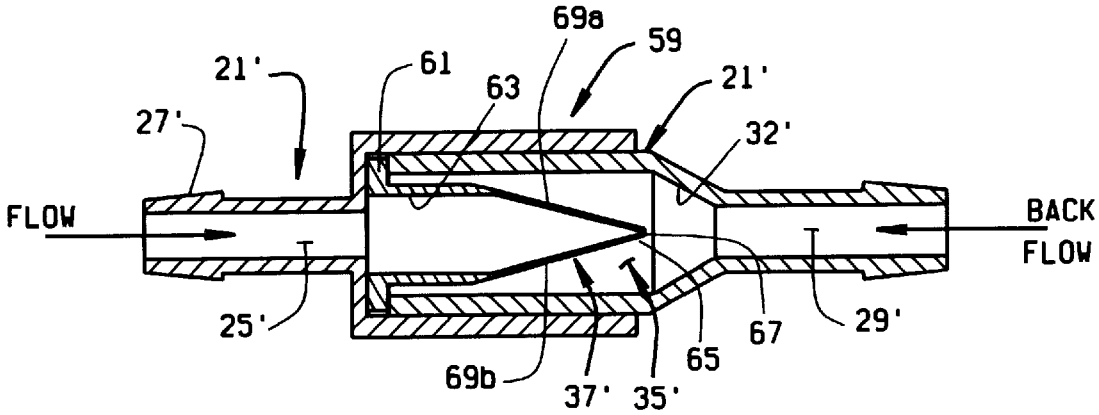
FIG. 8 is a longitudinal cross sectional view of still another embodiment of a check valve of the present invention having a "duckbill" or reed-type valve member with the valve member in its closed position.
Figure 9:
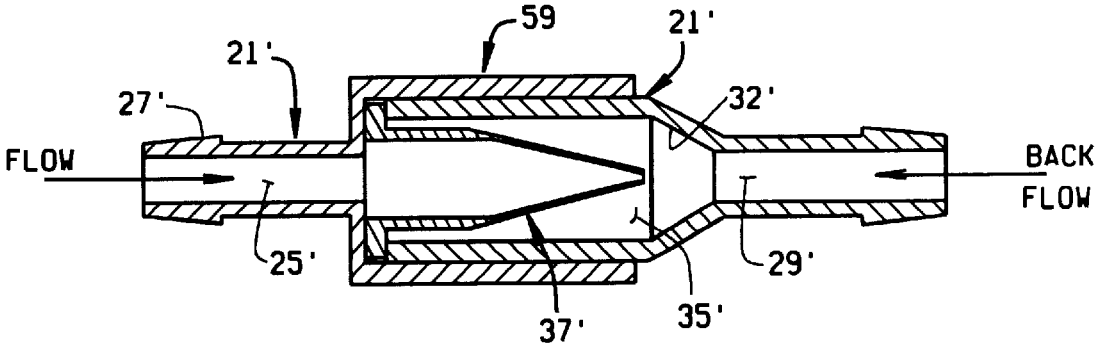
FIG. 9 is a view similar to FIG. 8 showing the "duckbill" valve member in its open position.
Figure 10:
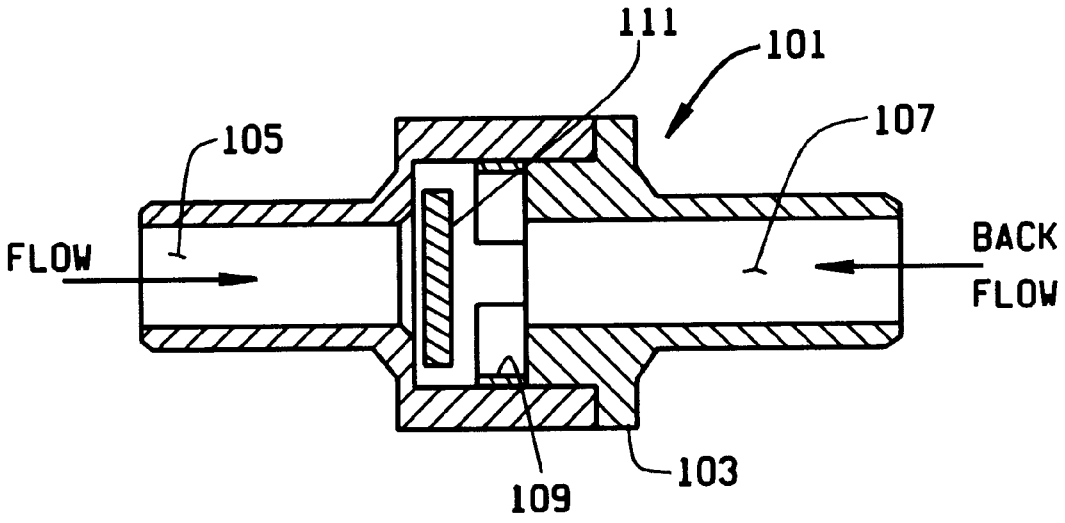
FIG. 10 PRIOR ART
FIG. 10 is a longitudinal cross sectional view of a first prior art check valve heretofore used with printheads.
Figure 11:
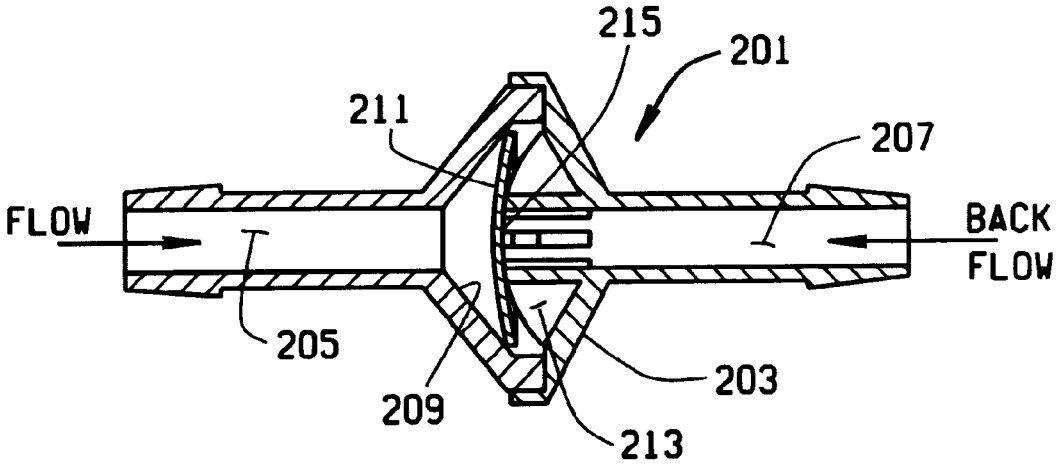
FIG. 11 PRIOR ART
FIG. 11 is a longitudinal cross sectional view of another embodiment of a prior art check valve heretofore used with printheads.

Referring now to FIGS. 8 and 9 illustrate another embodiment of the check valve or the present invention wherein the primary difference between the embodiment of FIGS. 3–7 and FIGS. 8 and 9 is the construction and operation of the valve member. Thus, the embodiment of FIGS. 8 and 9 is illustrated in its entirety by reference character 59 and corresponding parts of the embodiment of FIGS. 8 and 9 having a similar construction and operation to the components of the embodiments of FIGS. 3–7 are indicated by similar, but "primed" reference characters and thus the function and construction of these similar parts will not be herein separately described. With regard to the differences between the check valve 59 of FIGS. 8 and 9 and the check valves 19, as described above in regard to FIGS. 3–7, valve member 37' is a so-called "duckbill" or reed valve. Specifically, valve 37' comprises a unitary member molded of suitable silicone elastomer, such as ASTM 9668. The valve member 37' has a base flange 61 which is sealably secured within check valve chamber 35' and a tubular body 63 extending downstream from flange 61. The downstream end of valve member 37' tapers to a closed end 65 with a slit 67 between the upper and lower valve sections **69*a*, 69*b*. The valve sections 69*a*, 69*b* are molded so as to be normally closed. That is, the valve sections 69*a*, 69*b* are molded such that slit 67 is normally closed. Due to the elongate construction of valve sections 69*a*, 69*b* and due to the fact that the valve member 37' is molded of a suitable elastomer, as described above, the valve member, and particularly the valve sections 69*a*, 69*b***, are flexible.

In operation, upon the pressure within valve the valve sections **69*a*, 69*b* of valve 59 increasing even by a relatively small amount above the downstream pressure, as may be caused by a pulse of ink being caused to flow from ink supply 11 to printhead 3 at the above-noted very low flow rates and at very low pressure differentials (e.g., less than one inch of water pressure), the increased pressure within the valve sections 69*a*, 69*b* causes the valve sections to at least in part deform thereby to result in slit 67 opening to thus allow ink to flow from within the valve member into the valve chamber 35' downstream from valve member 37' and to flow to printhead 3. Upon a back pressure or shock wave emanating from printhead 3, the back pressure or shock wave will flow into check valve chamber 35' on the outside of the check valve sections 69***a*, 69*b* and will force the sections from their above-described open position in which slit 67 is open to a closed position in which slit 67 is closed thereby to prevent the back flow of ink through the check valve 59 toward the ink supply. It will be appreciated that it requires very little force (i.e., back pressure or shock wave) to effect closing of the valve sections 69*a*, 69*b* (which are molded in a normally closed position and which must be held in their open position by a nominal positive pressure within the valve members as ink flows from the ink supply to the printhead). Thus, valve member 59 will react very quickly to move from its open to its closed position upon being subjected to a back pressure or a shock wave from the printhead. Likewise, valve 59 exhibits a very low cracking pressure and offers little flow restriction and thus does not unduly impede the flow of ink to the printhead. Contamination particles within the ink have little adverse affect on the closing or opening of valve 59 due to the very flexible nature of valve sections 69*a*, 69*a* and due to the flexible nature of the outer ends of the valve sections and the slit to accommodate dirt particles and yet to effectively close the check valve 59.

In view of the above, it will be seen that the several objects and features of this invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

We claim:

1. A check valve for an ink supply line of an ink jet printing system between an ink reservoir and a inkjet printhead so as to prevent de-priming of said printhead upon said printhead being subject to impact loads, said check valve comprising a body having an inlet adapted to be connected to said ink reservoir and an outlet adapted to be connected to said printhead such that ink from said reservoir may be supplied to said printhead via said check valve, said check valve body having a chamber therewithin between said inlet and said outlet, and a check valve member within said chamber, said check valve having a flapper valve member movable between a closed position in which ink backflow from said chamber into said inlet is prevented and an open position in which ink from said inlet is substantially free to flow to said outlet and thence to said printhead, wherein the improvement comprises: said check valve member being a planar elastomeric member having an outer margin portion adapted to be mounted relative to said body, said outer margin surrounding said flapper valve, a slot separating said outer margin from said flapper valve with said flapper valve being movable relative to said outer margin between said open and closed positions, and a hinge integral with said flapper valve and with said outer margin so as to enable movement of said flapper valve from said closed position to said open position in response to ink flow to said printhead for enabling printing by said printhead and so as to enable movement of said flapper valve from said open position to said closed position in response to said printhead being subjected to impact loads thereby to minimize the tendency of said printhead to de-prime.

2. The check valve as set forth in claim 1 wherein said slot is of a generally part circular configuration such that said hinge integrally connects said flapper valve to said outer margin in such manner that relatively small pressure differentials between the upstream and downstream faces of said flapper valve effect hinged movement of said flapper valve between said open and closed positions.

3. The check valve as set forth in said claim 2 wherein said outer margin of said check valve member is held captive by said check valve body with said flapper valve being disposed within said chamber.

4. The check valve as set forth in claim 2 wherein said slot separating said flapper valve portion from said outer margin is of a sufficient width so as to effectively prevent particles in the ink from interfering with the opening and closing movement of said flapper valve portion relative to said outer margin.

5. A check valve for use in an ink supply system of an inkjet printing system so as to substantially prevent de-priming of an inkjet printhead upon said printhead being subjected to impact loads, said ink supply system comprising an ink supply and an ink supply line providing communication between said ink supply and said printhead, said check valve having a check valve body, said check valve body having an inlet body portion adapted to be connected to said ink supply via a portion of said ink supply line, an outlet body portion adapted to be connected to said printhead by another portion of said ink supply line, said check valve body further having a check valve chamber within said inlet and outlet body portions, an ink flow passage through said inlet body portion, through said chamber and through said outlet body portion, a portion of said check valve body defining a seat against which said flapper valve is engageable, a check valve member disposed within said check valve chamber, said check valve being of a sheet of elastomeric material having an outer margin adapted to be held captive between said inlet and outlet body portions, an elongate slot in said elastomeric sheet material defining a flapper valve with said slot separating said flapper valve from said outer margin and with said outer margin surrounding said flapper valve, and a hinge integral with said outer margin and with said flapper valve, said flapper valve being hingedly movable about said hinge between an open position in which ink is free to flow from said ink supply line into said chamber and a closed position in which said flapper valve is engageable with said seat so as to substantially prevent the flow of ink from said chamber into said ink supply line, said flapper valve being movable from said closed position to its open position in response to a decrease in ink pressure within said chamber below the pressure of said ink within said ink supply line and being movable from said open position to said closed position in response to an increase in pressure within said chamber greater than said pressure within said ink supply line as occasioned by said printhead being struck by an object moving past said printhead thereby to reduce the tendency of the printhead to de-prime.

6. A check valve for an ink supply line of an ink jet printing system between an ink reservoir and a inkjet printhead so as to prevent de-priming of said printhead upon said printhead being subjected to impact loads, said check valve comprising a body having an inlet adapted to be connected to said ink reservoir and an outlet adapted to be connected to said printhead such that ink from said reservoir may be supplied to said printhead via said check valve, said check valve body having a chamber between said inlet and said outlet, and a check valve member within said chamber, said check valve having a valve seat and a flapper valve member movable between a closed position in which said flapper member is seated on said valve seat to prevent ink backflow from said chamber into said inlet is prevented and an open position in which ink from said inlet is substantially free to flow to said outlet and thence to said printhead, wherein the improvement comprises: said check valve member being a planar elastomeric member having an outer margin portion adapted to be mounted relative to said body, a slot separating said outer margin from said flapper valve such that said outer margin surrounds said flapper valve, said flapper valve being substantially coplanar with said outer margin when said flapper valve is in its closed position, said flapper valve being sized relative to said valve seat such the outer margins of said flapper valve is in substantially face-to-face sealing relation with said valve seat when said flapper valve is in its closed position, said flapper valve being movable relative to said outer margin and relative to said valve seat between said open and closed positions, and a hinge substantially coplanar with said flapper valve and with said outer margin, said hinge being integral with said flapper valve and with said outer margin so as to enable movement of said flapper valve from said closed position to said open position in response to ink flow to said printhead for enabling printing by said printhead and so as to enable movement of said flapper valve from said open position to said closed position in response to said printhead being subjected to impact loads thereby to minimize the tendency of said printhead to de-prime.

* * * * *